US005714963A

United States Patent [19]

Cox

[11] Patent Number: 5,714,963

[45] Date of Patent: Feb. 3, 1998

[54] ANTENNA-TO-RADIO QUICK-CONNECT SUPPORT DEVICE

[75] Inventor: Gary A. Cox, Melvin, Australia

[73] Assignee: Andrew Corporation, Orland Park, Ill.

[21] Appl. No.: 540,415

[22] Filed: Oct. 6, 1995

[51] Int. Cl.[6] ..... H01Q 13/00

[52] U.S. Cl. ..... 343/786; 343/772; 343/906; 439/314

[58] Field of Search ..... 343/772, 786, 343/840, 906; 439/314, 316, 317, 318, 319, 920

[56] References Cited

U.S. PATENT DOCUMENTS

| | | | |
|---|---|---|---|
| 3,162,858 | 12/1964 | Cutler | 343/840 |
| 3,286,270 | 11/1966 | Kelly | 343/840 |
| 3,982,808 | 9/1976 | Marechal | 439/314 X |
| 4,445,743 | 5/1984 | Bakker | 439/318 X |
| 5,551,080 | 8/1996 | Chambers et al. | 343/906 X |
| 5,561,439 | 10/1996 | Moilanen | 343/773 X |

FOREIGN PATENT DOCUMENTS

| | | |
|---|---|---|
| WO96/05629A1 | 2/1996 | WIPO . |

*Primary Examiner*—Donald T. Hajec
*Assistant Examiner*—Tho Phan
*Attorney, Agent, or Firm*—Arnold, White & Durkee

[57] ABSTRACT

A connector assembly for connecting a microwave antenna to a radio unit. The connector assembly comprises a central hub including a waveguide and adapts for connection to the antenna for transmitting microwave signals to and from the antenna. A first latching element is attached to the hub and a second latching element adapts for connection to the radio unit and cooperates with the first latching element for latching and unlatching in response to rotational movement of the second latching element relative to the first latching element.

9 Claims, 6 Drawing Sheets

ANTENNA-TO-RADIO QUICK-CONNECT SUPPORT DEVICE

FIELD OF THE INVENTION

The present invention relates to connectors for connecting and disconnecting antennas and radio equipment, such as the antennas and radio equipment used in the base stations of cellular communication systems.

SUMMARY OF THE INVENTION

It is a primary object of the present invention to provide an improved connector which permits an antenna to be quickly connected to, or disconnected from, the radio equipment with which it is used in the field.

It is another object of this invention to provide such an improved connector which is self-compensating for component tolerances, thereby ensuring consistent, reliable electrical connections.

A further object of this invention is to provide such an improved connector which can be efficiently and economically manufactured in large quantities.

Yet another object of the invention is to provide such an improved connector that is capable of supporting radio equipment of considerable weight, so that additional support brackets or the like are not needed.

A still further object of this invention is to provide such an improved connector which requires only a small number of parts.

Another object of the invention is to provide such an improved connector which is universal in application in that it can be used with a wide variety of different radio equipment.

Other objects and advantages of the invention will be apparent from the following detailed description and the accompanying drawings.

In accordance with the present invention, the foregoing objectives are realized by providing a connector assembly which comprises a central hub including a waveguide and adapted for connection to the antenna for transmitting microwave signals to and from the antenna, a first latching element attached to the hub, and a second latching element adapted for connection to the radio unit and cooperating with the first latching element for latching and unlatching the latching elements in response to rotational movement of the second latching element relative to the first latching element.

DETAILED DESCRIPTION OF PREFERRED EMBODIMENT

Figure 1:
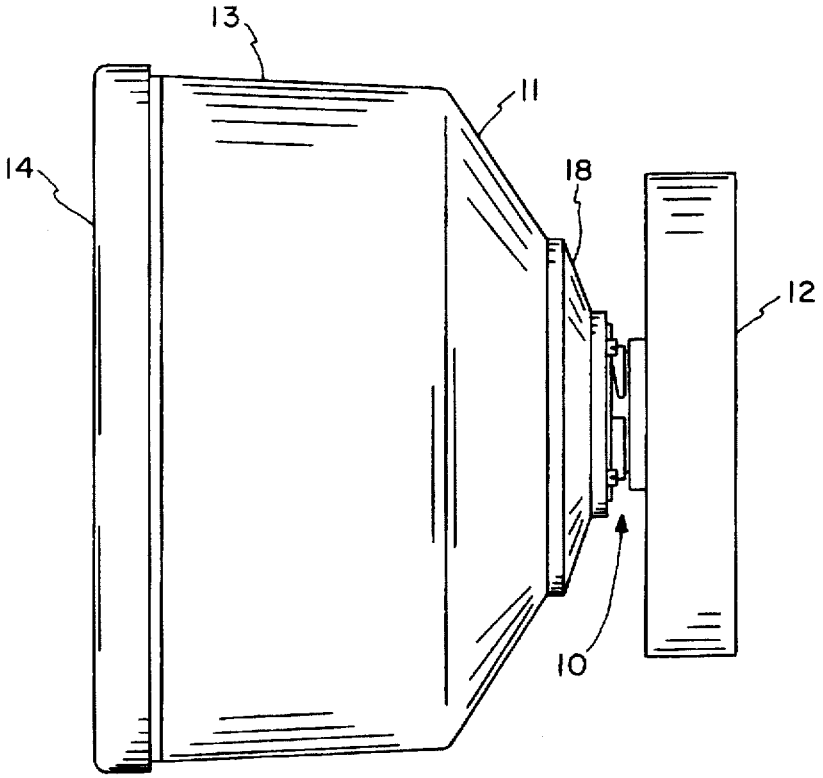
FIG. 1 is a side elevation of a microwave antenna and a radio unit connected to each other by a connector assembly embodying the present invention.
Figure 2:
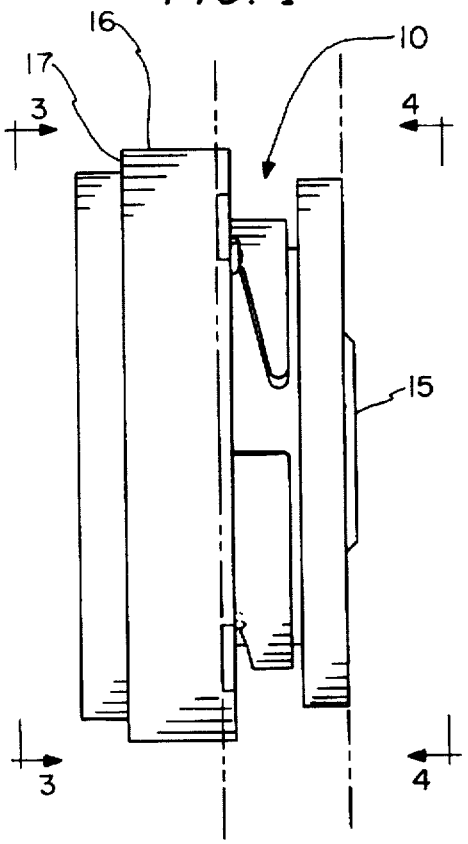
FIG. 2 is an enlarged side elevation of the connector assembly shown in FIG. 1.
Figure 3:
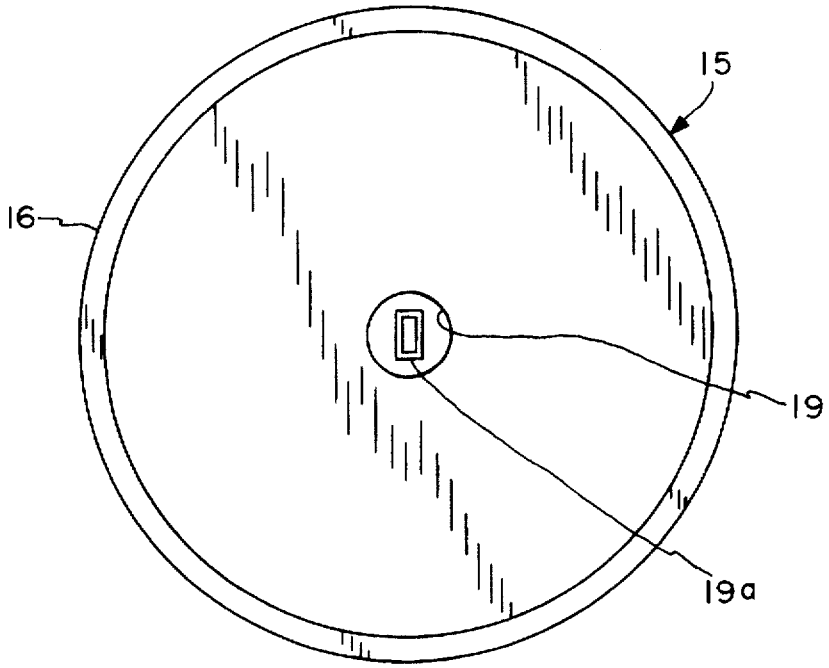
FIG. 3 is an end elevation taken along line 3—3 in FIG. 2.
Figure 4:
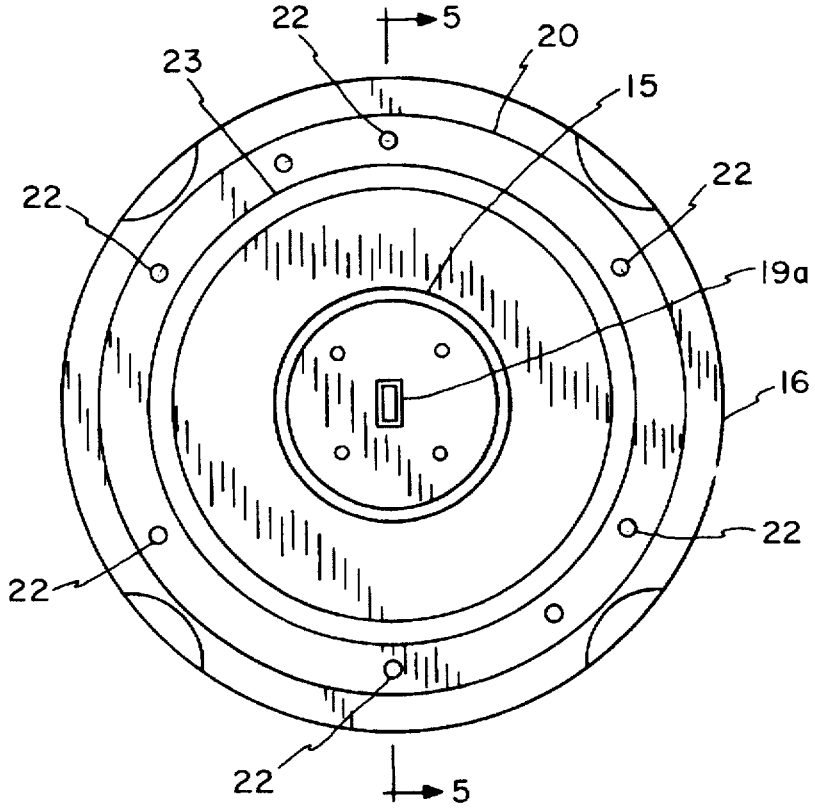
FIG. 4 is an end elevation taken along line 4—4 in FIG. 2.

While the invention is susceptible to various modifications and alternative forms, a specific embodiment thereof has been shown by way of example in the drawings and will be described in detail herein. It should be understood, however, that it is not intended to limit the invention to the particular forms disclosed, but on the contrary, the intention is to cover all modifications, equivalents, and alternatives falling within the spirit and scope of the invention as defined by the appended claims.

Figure 5:
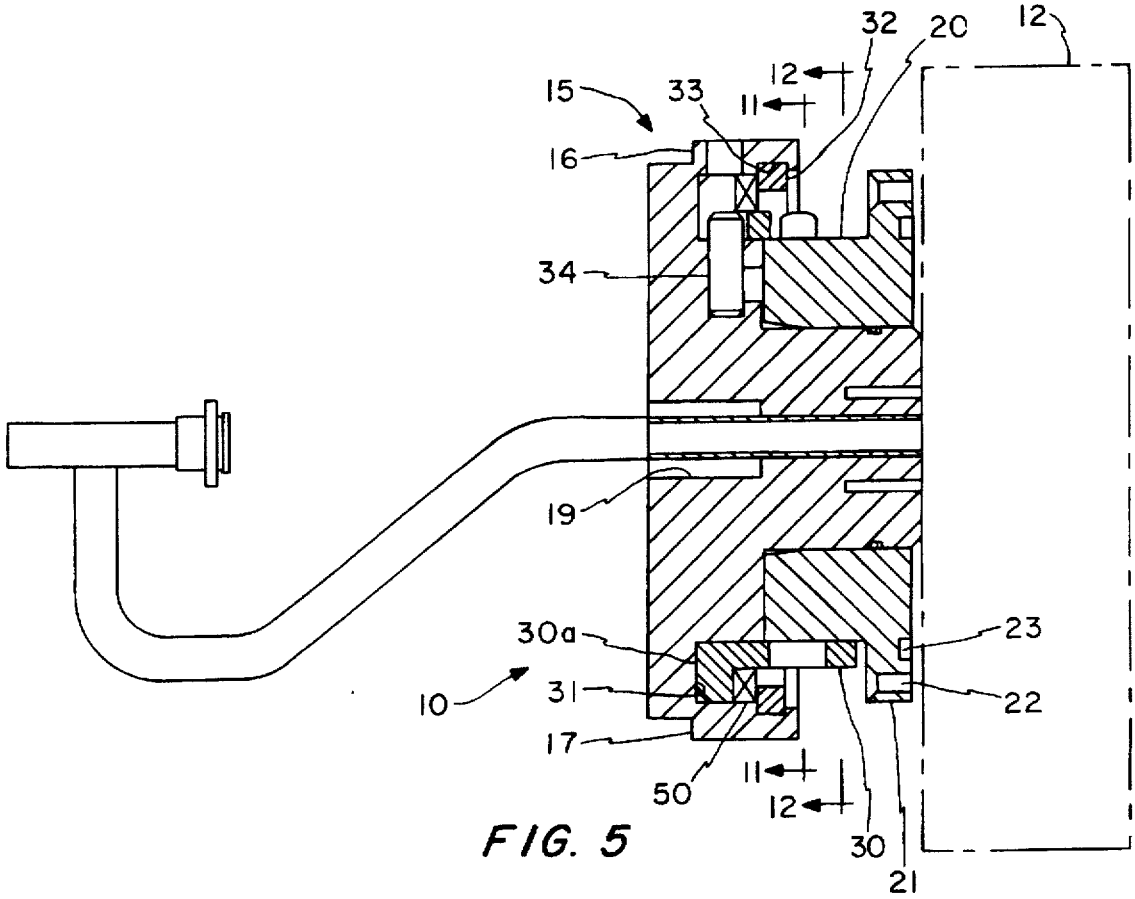
FIG. 5 is a section taken generally along line 5—5 in FIG. 4.
Figure 6:
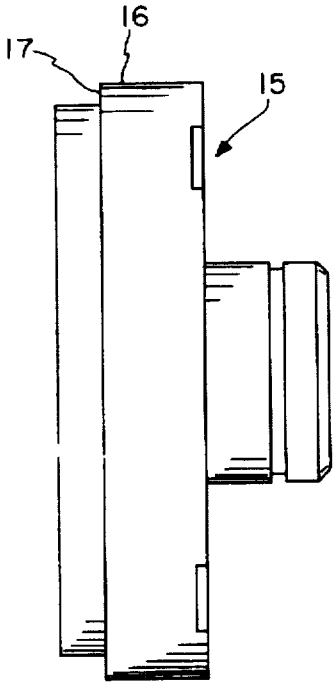
FIG. 6 is a side elevation of the feed hub included in the connector assembly of FIGS. 2 through 5.
Figure 7:
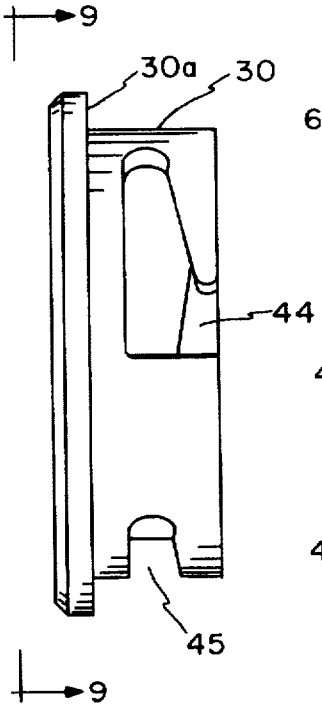
FIG. 7 is a side elevation of a first latching element included in the connector assembly of FIGS. 2 through 5.
Figure 8:
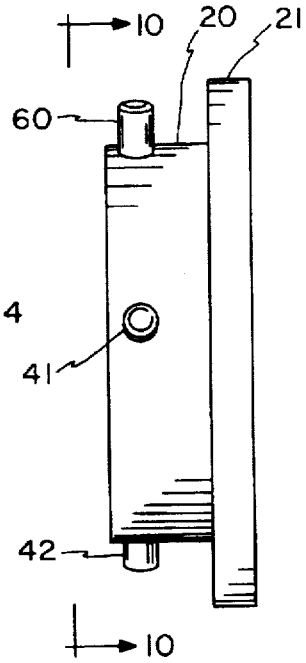
FIG. 8 is a side elevation of a second latching element included in the connector assembly of FIGS. 2 through 5.
Figure 9:
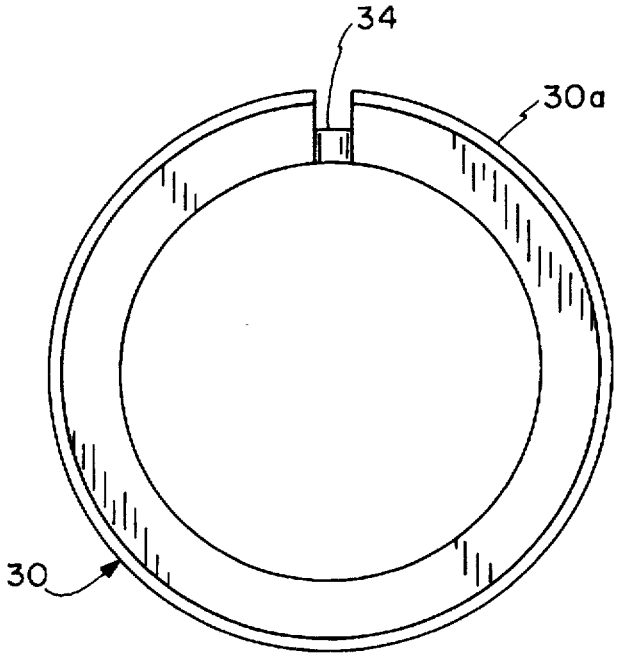
FIG. 9 is an end elevation taken along line 9—9 in FIG. 7.
Figure 10:
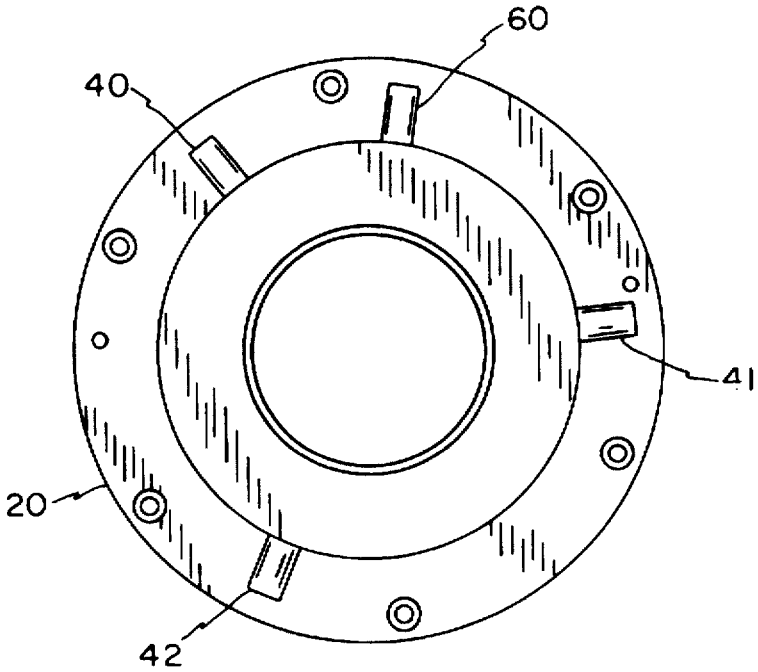
FIG. 10 is an end elevation taken along line 10—10 in FIG. 8.
Figure 11:
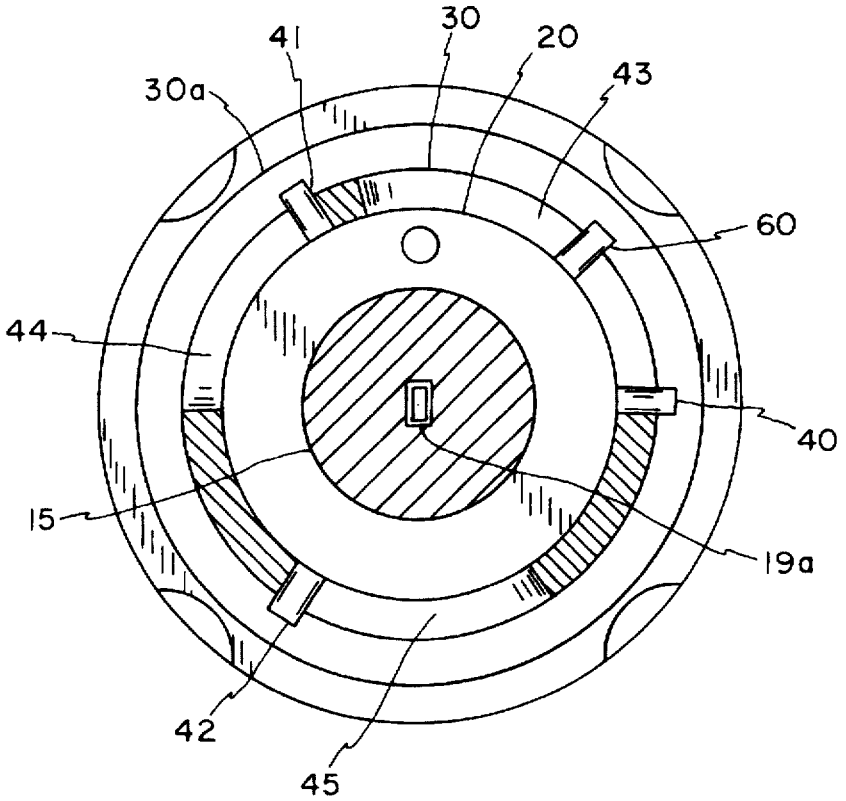
FIG. 11 is a section taken generally along line 11—11 in FIG. 5.

Turning now to the drawings and referring first to FIG. 1, a connector assembly 10 embodying the present invention is shown connecting a conventional reflector-type microwave antenna 11 to a radio unit 12 such as a transceiver. The large open end of the antenna 11 is surrounded by a cylindrical shield 13 closed by a radome 14. The core of the connector assembly 10 is formed by a feed hub 15 having a tangled end 16 forming a shoulder 17 dimensioned to mesh with a casting 18 attached to the parabolic reflector of the antenna 11. The feed hub 15 also forms a central axial passageway 19 containing a rectangular waveguide **19*a* to transmit microwave signals between the antenna 11 and the radio unit 12. The waveguide 19*a* also forms at least a portion of the feed for the antenna 11**, as shown in FIG. 5.

The radio unit 12 is attached to a first latching element 20 which telescopes over the central portion of the radio end of the hub 15, as viewed in FIGS. 5–8. A flange 21 on the radio end of the latching element 20 has a plurality of screw holes 22 extending therethrough for rigidly fastening the latching element 20 to the radio unit 12. A circular groove 23 inboard of the screw holes 22 receives an O-ring (not shown) to provide a fluid seal at the interface between the connector assembly 10 and the radio unit 12.

In order to latch the feed hub 15 and the first latching element 20 together in the axial direction, a second latching element in the form of a collar 30 fits over contiguous portions of the feed hub 15 and the first latching element 20. The antenna end of the latching collar 30 forms an outwardly extending flange **30*a* and nests in an annular recess 31 formed in the outer portion of the tangled end 16 of the feed hub 15. The collar 30 is captured in the recess 31 of the hub 15 by a retaining ring 32 which fits into a narrow groove 33 in the outer wall of the recess 31. To lock the latching collar 30 against rotational movement relative to the feed hub 15, a locking pin 34 fits into mating radial holes formed in the hub 15 and the collar 30. The hole in the collar 30 is elongated in the axial direction to permit limited axial movement of the collar 30 relative to the hub 15**.

Figure 12:
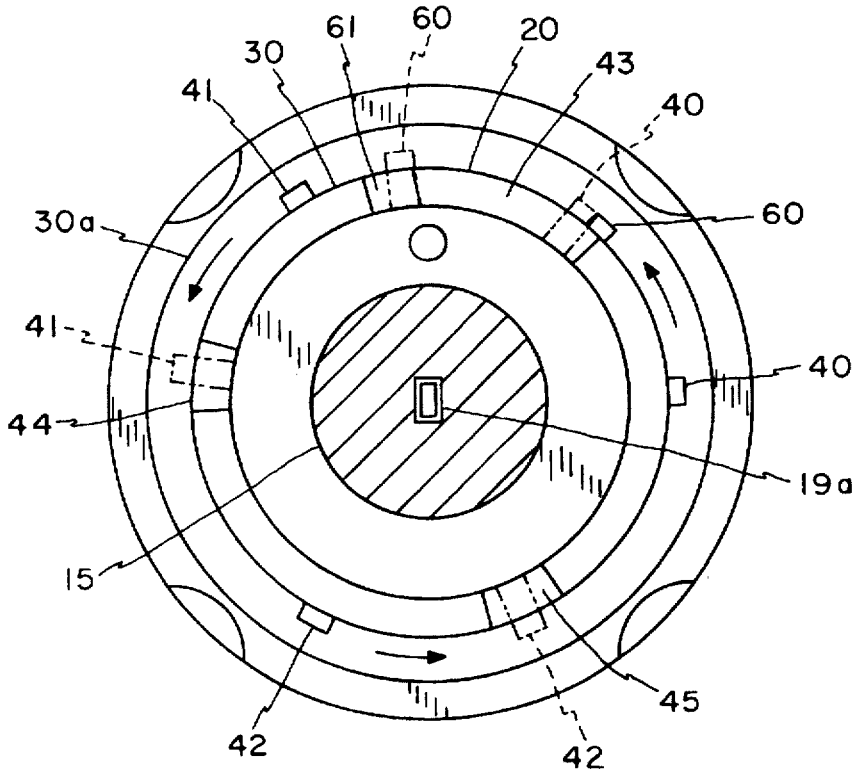
FIG. 12 is a section taken generally along line 12—12 in FIG. 5.
Figure 13:
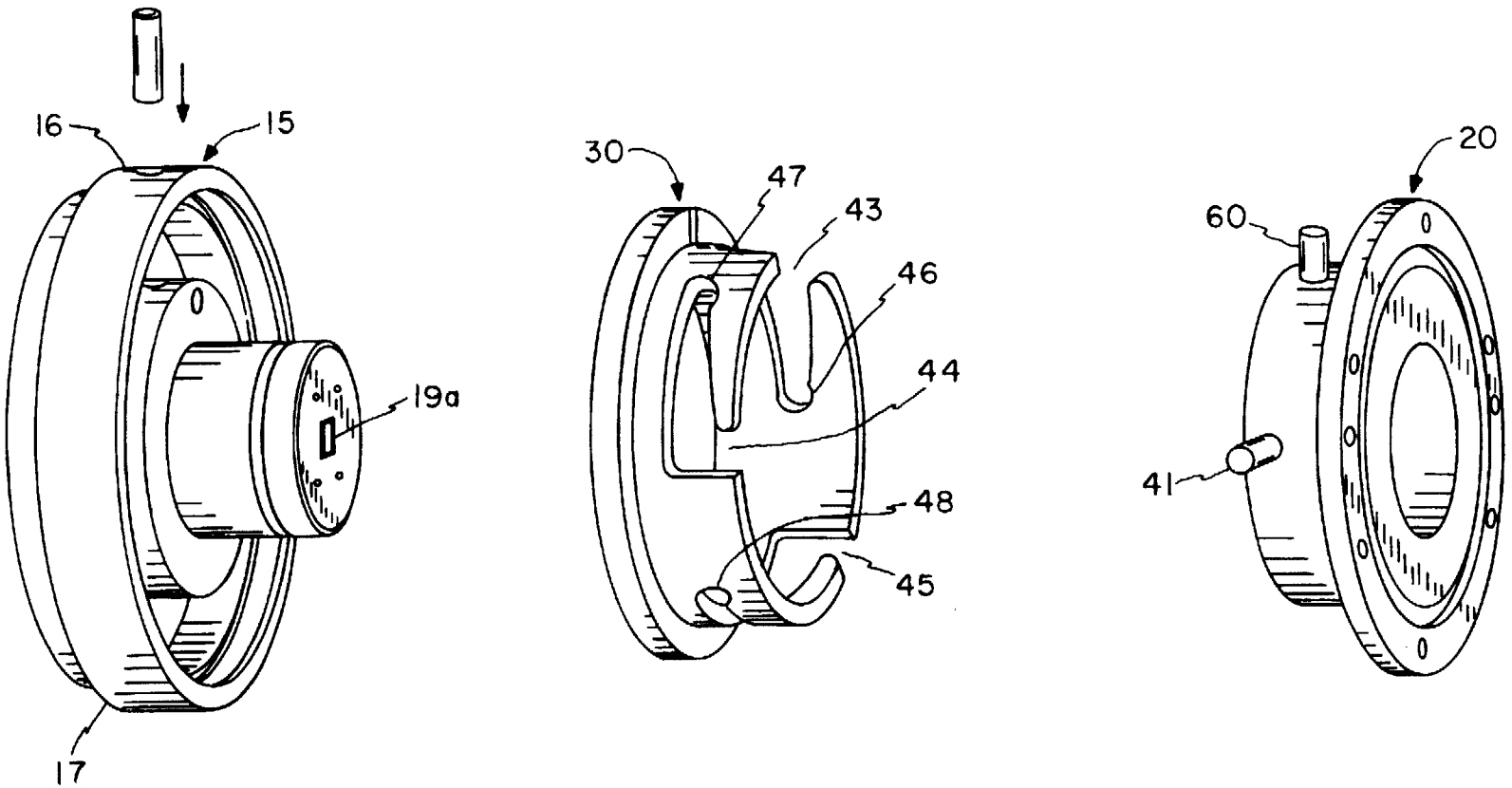
FIG. 13 is an exploded perspective of the connector assembly of FIGS. 2 through 12.

Latching of the elements 20 and 30 is effected by cooperating engagement of three radial pins 40, 41 and 42 on the latching element 20 with three complementary L-shaped slots 43, 44 and 45 in the latching collar 30. When the two latching elements 20 and 30 are telescoped together, as shown in FIG. 12, the pins 40–42 fit into the open throats of the slots 43–45 at the radio end of the collar 30. Then when the latching element 20 is rotated within the collar 30, in a clockwise direction as viewed in FIG. 12, the pins 40–42 are advanced circumferentially within the slots 43–45 until the pins snap into detent notches 46, 47 and 48 at the closed ends of the slots.

To ensure firm engagement between the radio end of the hub 15 and the radio unit 12 attached to the latching element 20, for a reliable electrical contact, an annular wave spring 50 is captured between the retaining ring 32 and the flange 30*a* of the latching collar 30. When the wave spring 50 is compressed, it applies an axial biasing force on the latching collar 30, urging the collar 30 toward the antenna 11. The collar 30 transmits this axial biasing force to the radio sides of the pins 40–42 via the radio sides of the slots 43–45. Thus, the latching element 20 is biased toward the antenna 11, which in turn biases the radio unit 12 firmly against the radio end of the feed hub 15 to ensure a reliable electrical contact at the radio end of the waveguide 19*a*.

Because the wave spring 50 biases the radio sides of the slots 43–45 against the corresponding latching pins 40–42, the pins are engaged by the inclined walls 40*a*, 41*a* and 42*a* on the radio sides of the respective slots as the latching element 20 is turned toward the fully latched position. When the pins 40–42 reach the detent notches at the ends of their respective slots 43–45, the biasing force from the wave spring 50 continues to urge the latching collar 30 against the pins 40–42, thereby holding the pins in the detent positions until the latching element 20 is turned in the opposite direction to unlatch the assembly.

After the radio unit engages the radio end of the feed 15, the latching element 20 cannot move any further toward the antenna 11. Thus, continued angular movement of the latching element 20 causes the pins 40–42 to draw the latching element 30 toward the radio unit 12, thereby compressing the wave spring 50. As the spring 50 is compressed, it applies an increasing force to the collar 30, thereby drawing the radio unit 12 tightly against the end of the hub 15, via the pins 43–45 and the latching element 20. This tight engagement ensures a reliable electrical contact between the waveguide walls at the radio end of the hub 15 and the mating surfaces in the radio unit 12. Moreover, the spring 50 in combination with the limited axial sliding movement of the latching collar 30 ensure tight engagement, even in the event of accumulating component tolerances.

To ensure proper angular alignment of the radio end of the waveguide 19*a* with the radio unit 12 attached to the latching element 20, the entry throat of the slot 43 is elongated to receive a fourth pin 60 spaced slightly away from the pin 40. The slot 43 is the only slot with an entry throat wide enough to receive the fourth pin 60, and thus there is only one angular position in which the two latching elements will fit together. This fourth pin 60 also engages a camming surface 61 formed by the edge of the slot 43 adjacent the entry throat, and the camming action of the surface 61 initiates rotational movement of the latching element 20 so that the operator knows in which direction to turn the element 20.

When it is desired to release the connector assembly I0, the latching element 20 is turned counter-clockwise (as viewed in FIG. 12) relative to the collar 30 to release the pins 40–42 from the detent notches in the slots 43–45. Turning the latching element 20 through an angle of about 30 degrees brings the pins into alignment with the open entry throats of the slots, and at that time the collar 30 and the hub 15 can be removed from the latching element 20 by sliding the parts away from each other in the axial direction.

I claim:

1. A connector assembly for connecting a microwave antenna to a radio unit, said connector assembly comprising;

a central hub including a waveguide and adapted for connection to the antenna for transmitting microwave signals to and from the antenna, first latching element attached to said hub, and a second latching element adapted for connection to the radio unit and cooperating with said first latching element for latching and unlatching said latching elements in response to rotational movement of said second latching element relative to said first latching element.

2. The connector assembly of claim 1 wherein said first latching element is mounted for limited sliding movement relative to said central hub in the axial direction, and which includes biasing means urging said first latching element axially away from said second latching element.

3. The connector assembly of claim 1 which includes at least one radial pin on one of said latching elements, and at least one slot in the other latching element for receiving said pin and camming said first latching element in an axial direction in response to rotational movement of said latching elements relative to each other.

4. The connector assembly of claim 1 which includes means for preventing relative rotational movement of said first latching element and said central hub.

5. The connector assembly of claim 1 wherein said first and second latching elements include angular alignment means for allowing said latching elements to fit together only when said second latching element is in a predetermined angular position relative to said first latching element.

6. A connector assembly for connecting a microwave antenna to a radio unit, said connector assembly comprising:

a central hub including a waveguide and adapted for connection to the antenna for transmitting microwave signals to and from the antenna, a first latching element attached to said hub and mounted for limited sliding movement relative to said central hub in the axial direction, a second latching element adapted for connection to the radio unit and cooperating with said first latching element for latching and unlatching said latching elements in response to rotational movement of said second latching element relative to said first latching element, biasing means for urging said first latching element axially away from said second latching element and wherein said latching elements include camming means for displacing said first latching element against the force of said biasing means during rotational movement of said latching elements between latched and unlatched positions.

7. A connector assembly for connecting a microwave antenna to a radio unit, said connector assembly comprising:

a central hub including a waveguide and adapted for connection to the antenna for transmitting microwave signals to and from the antenna, a first latching element attached to said hub and mounted for limited sliding movement relative to said central hub in the axial direction, a second latching element adapted for connection to the radio unit and cooperating with said first latching element for latching and unlatching said latching elements in response to rotational movement of said second latching element relative to said first latching element, and a wave spring captured between said first latching element and said central hub for urging said first latching element axially away from said second latching element.

8. The connector assembly for connecting a microwave antenna to a radio unit, said connector assembly comprising:

a central hub including a waveguide and adapted for connection to the antenna for transmitting microwave signals to and from the antenna, a first latching element attached to said hub, a second latching element adapted for connection to the radio unit and cooperating with said first latching element for latching and unlatching said latching elements in response to rotational movement of said second latching element relative to said first latching element, and wherein said central hub forms an annular recess for receiving said first latching element, and said central hub in cooperation with said first latching element forms a second annular recess for receiving said second latching element.

9. A connector assembly for connecting a microwave antenna to a radio unit, said connector assembly comprising:

a central hub including a waveguide and adapted for connection to the antenna for transmitting microwave signals to and from the antenna, a first latching element attached to said hub and mounted for limited sliding movement relative to said central hub in the axial direction, a second latching element adapted for connection to the radio unit and cooperating with said first latching element for latching and unlatching said latching elements in response to rotational movement of said second latching element relative to said first latching element, a wave spring captured between said first latching element and said central hub for urging said first latching element axially away from said second latching element, said central hub forming an annular recess for receiving said first latching element, and said central hub in cooperation with said first latching element forming a second annular recess for receiving said second latching element, and said latching elements include camming means for displacing said first latching element against the force of said wave spring during rotational movement of said latching elements between latched and unlatched positions.

* * * * *